US006756900B2

(12) United States Patent
Leyden et al.

(10) Patent No.: US 6,756,900 B2
(45) Date of Patent: Jun. 29, 2004

(54) VOLTAGE SELECTABLE ALARM SENSOR

(75) Inventors: Roger J. Leyden, Willow Springs, IL (US); Peter J. Passuntino, Wheaton, IL (US); Michael A. Parent, Palatine, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 167 days.

(21) Appl. No.: 10/037,521

(22) Filed: Jan. 4, 2002

(65) Prior Publication Data

US 2003/0128118 A1 Jul. 10, 2003

(51) Int. Cl.[7] ..... G08B 13/14

(52) U.S. Cl. ..... 340/568.4; 340/568.1; 340/568.2; 340/568.3; 340/568.8; 340/572.8; 439/917

(58) Field of Search ..... 340/568.4, 568.1, 340/568.2, 568.3, 568.8, 506, 653, 693.1, 693.4, 686.1, 687, 571, 572.8, 572.9; 200/61.18; 439/531, 676, 917, 924.1

(56) References Cited

U.S. PATENT DOCUMENTS

| | | | | | |
|---|---|---|---|---|---|
| 6,104,289 | A | * | 8/2000 | Rand | 340/568.4 |
| 6,380,855 | B1 | * | 4/2002 | Ott | 340/568.2 |
| 6,476,717 | B1 | * | 11/2002 | Gross et al. | 340/568.1 |
| 6,570,502 | B2 | * | 5/2003 | Matsuo | 340/568.2 |

* cited by examiner

*Primary Examiner*—Davetta W. Goins
(74) *Attorney, Agent, or Firm*—Greenberg Traurig, P.C.; Richard D. Harris

(57) ABSTRACT

The present invention is directed to an apparatus and method involving a voltage selectable alarm sensor for operably mounting an anti-theft device to an article being monitored. The voltage selectable alarm sensor comprises a sensor housing, a detector switch having at least first and second alternative positions to indicate that an alarm event is occurring, an electrical cord for providing power to the alarm sensor which power is then directed to the article being monitored through connection to a power output port on the sensor. The voltage emanating from the power output port and directed to the article may be varied by a voltage selection switch positioned on the sensor.

40 Claims, 4 Drawing Sheets

40
41
42
43
44
45
46
47
48
49
50
5
60
61
65
70

VOLTAGE SELECTABLE ALARM SENSOR

BACKGROUND OF THE INVENTION

1. Field of the Invention

The present invention is directed to display alarm sensors and, in particular, a voltage selectable alarm sensor incorporated into a security device for use in theft prevention.

2. Background Art

Product displays in consumer electronic stores often incorporate security systems that simultaneously allow consumers to examine and test fully functioning consumer electronic products without exposing the storeowner to a risk of theft. Such security systems may simply involve attaching a retractable tether from the consumer display to the consumer electronic product. More advanced systems may also incorporate an electronic alarm system that alerts store personnel both visually and audibly in the event the alarm sensor becomes disconnected either from the product or from the product display.

Handheld cameras, camcorders and other smaller electronics are ripe for such retail theft. Because of size and features of such electronics, consumers prefer to handle and manipulate these products prior to purchase, to determine if the features in a particular model of product are suitable for the consumer's intended use. To permit the products to operate, the products are typically powered by some sort of electrical cord—one cord for each product. Moreover, because different products may require different voltages to power the product, many power sources or adapters are often required—one for each product.

Thieves are particularly attracted to stealing handheld cameras and other small electronics because the devices are easily accessible, expensive and portable. In response, storeowners typically attach an electronic alarm sensor along with a tether to the cameras on display typically with one tether attached to each product. The combination of the electrical cords to power the products and the tethers from the alarm sensors create an unsightly and visually unappealing display, often with an exposed maze of wiring.

Prior art alarms sensors have attempted to reduce the number of tethers or cords by powering the products from the alarm sensors instead of from a separate plug or voltage-regulating adapter. However, these systems typically regulate voltage through the use of different electrical cords connecting the alarm sensor to the product. For example if 4 volts were required, a 4-volt adapter cord would be connected from the outlet plug or the sensor to the product. Such arrangements may actually increase the number of electrical cords that a retailer would require. Product manufacturers have unfortunately not standardized the connections, instead using proprietary connections. As such, the retailer would require at least one electrical cord per voltage to be outputted per each special, proprietary connection.

There are other disadvantages to prior art alarm sensors—aside from too many cords creating an unsightly display and the product powering issues. For example, many of these prior art alarm sensors use small light emitting diodes to indicate when an alarm sensor is not attached to a product, i.e. an alarm event. While products are generally portable, the products may still be large enough to visually obscure the light emitting diode.

It would be desirable to provide an alarm sensor that reduces the number of electrical cords and tethers in a display area.

It would also be desirable to provide such an alarm sensor that eliminates the need to inventory many variations of electrical cords to power the varying cameras and other electrical products available.

It would still further be desirable to simplify the installation of an alarm sensor to a product being monitored.

It would also be desirable to provide a means to increase the visibility of the alarm sensor indicating that an alarm event is occurring—in the environment of an efficient, difficult to bypass theft prevention system.

These and other desirable characteristics of the invention will become apparent in view of the following specification and claims.

SUMMARY OF THE INVENTION

The present invention is a voltage selectable alarm sensor for operably mounting an anti-theft device to an article being monitored. The alarm sensor comprises a sensor housing with top and bottom surfaces, where the top surface is adjacent to the article to be monitored when the alarm sensor housing is mounted to the article by a mounting member, a detector switch operably positioned proximate to the top surface of the alarm sensor having at least a first and a second orientation, in which the first orientation indicates that the alarm sensor is operably and properly mounted on the article and the second orientation indicates that the alarm sensor is not operably and properly mounted onto the article so as cause an alarm event; an electrical cord for providing power to the alarm sensor, where the cord also provides for communicating between the alarm sensor and a remote alarm detection unit—towards determining the current orientation of the detector switch and whether, in turn, an alarm event is actually occurring. The electrical cord also provides power to the alarm sensor for further direction to the article being monitored, through a power output port capable of producing and providing electrical current of varying voltages to electrically operate the article where the voltage is selected by a voltage selection switch for selecting a desired electrical voltage, from amongst a plurality of available voltages.

In a preferred embodiment of the invention, the mounting member is a combination of a layer of releasable adhesive applied to the top surface of the sensor housing so as to be sandwiched between the alarm sensor and the article being monitored; and a threaded fastener that extends from the top surface of the sensor housing for mated receipt by a threaded aperture located in the article. The alarm sensor also includes a device for visually determining the orientation of the detector switch as well as a device for visually determining the voltage selected for transmission through the power output port to the article. In this preferred embodiment, the voltage selection switch is a slide switch having at least three predetermined positions for selecting the voltage to be transmitted to the power output port. Connecting the output port to the article is one of a plurality of adapter cords for providing power to the article to permit the article to function. Each of the adapter cords preferably includes one standardized connector for mated connection with the power output port of the sensor housing—and a non-standardized connector for mated connection to the incoming power port of the article.

In another embodiment, the voltage selectable alarm sensor comprises a substantially rectangular housing having a top and a bottom surface, where the top surface is adjacent to the article being monitored when the sensor housing is operably mounted to said article. The sensor housing is mounted to the article by a layer of releasable adhesive applied to the top surface of the sensor housing so as to be sandwiched between the alarm sensor and the article being and further secured by a threaded fastener that extends from the top surface of the sensor housing for mated receipt by a threaded mounting aperture located in the said article. A detector switch is positioned proximate to the top surface of the sensor housing whereby the detector switch likewise has at least a first and a second orientation. The first orientation indicates that the alarm sensor is operably and properly mounted on the article and the second orientation indicates that the alarm sensor is not operably and properly mounted onto the article thereby causing an alarm event. An electrical cord for providing power to the alarm sensor is attached to the sensor. The electrical cord also provides a way for communicating with a remote alarm detection unit towards determining the current orientation of the detector switch and, in turn, whether an alarm event is occurring as well as a way to power not only the alarm sensor but also the article being monitored. The sensor housing preferably includes a power output port capable of producing and providing electrical current of one of at least three predetermined voltages—as transmitted from said electrical cord and a slide switch having at least three predetermined positions for selecting the voltage provided by the power output port to one of at least three predetermined voltages.

In this embodiment, a light emitting diode visually indicates whether that the detector switch is in the first orientation or the second orientation. Preferably, the light emitting diode for visually indicating said orientation of the detector switch is constantly illuminated when the alarm sensor is receiving power through the electrical cord and the detector switch is in the first orientation and intermittently illuminated when the alarm sensor is receiving power and the detector switch is in the second orientation. Likewise the sensor housing includes a set of at least three light emitting diodes each corresponding to one of the at least three predetermined positions of the slide switch and the at least three predetermined voltages, and capable of illumination so as to indicate which of the at least three predetermined voltages is provided by the power output port.

The voltage selectable alarm sensor further includes a plurality of adapter cords, where one of the adapter cords is provided for connecting the power output port to the article input port, thereby providing power to the article to permit said article to function. It is preferable if each of the plurality of adapter cords are configured with a standardized connector on one end for mated connection with the power output port and a non-standard connector on the other end for mated connection with the article.

In another preferred embodiment, a voltage selectable alarm sensor for operably mounting an anti-theft device to an article being monitored, comprises a substantially cylindrical sensor housing including a top and a bottom, where the top end is proximate to the article being monitored when the sensor housing is operably mounted to the article. The alarm sensor is mounted to the article through a mounting member so to engage a detector switch having at least a first and a second orientation, where the first orientation indicates that the alarm sensor is operably and properly mounted on the article and the second orientation indicates that the alarm sensor is not operably and properly mounted onto the article thereby causing an alarm event.

In this embodiment, a substantially circular security indicator ring is provided, having a top and bottom surface and positioned so that the bottom surface is adjacent the top end of said sensor housing at the top end's circumference. The security indicator ring is capable of illumination for visual detection from a range of locations so as to indicate the first and second orientations of the detector switch, which is operably positioned adjacent the indicator ring and the article being monitored. Providing power to the alarm sensor, an electrical cord likewise provides for communicating with a remote alarm detection unit, towards determining the current orientation of the detector switch and, in turn, whether an alarm event is occurring. The electrical cord also provides power to the alarm sensor and the article being monitored. Preferably, the sensor housing also includes a power output port capable of producing and providing electrical current of varying voltages to at least operate the article electrically and a voltage selection switch for selecting a desired voltage from amongst a plurality of available voltages to operate alternative articles of varying voltage demands.

In a further embodiment, the voltage selectable alarm sensor comprises a substantially cylindrical sensor housing having a top and a bottom end, where the top end is proximate to the article being monitored when the sensor housing is operably mounted to the article. The alarm sensor includes a detector switch having at least a first and a second orientation, where the first orientation indicates that the alarm sensor is operably and properly mounted on the article and the second orientation indicates that the alarm sensor is not operably and properly mounted onto the article thereby causing an alarm event. A substantially circular security indicator ring has top and bottom surfaces and is likewise positioned so that the bottom surface is adjacent the top end of the sensor housing at the top end's circumference, where the indicator ring is capable of illumination for visual detection from a range of locations so as to indicate the first and second orientations of the detector switch, which is operably positioned adjacent the indicator ring and the article.

A threaded fastener that extends from proximate the top of the security indicator ring is again used to mount the alarm sensor into a threaded mounting aperture located in the article being monitored. A stabilization peg extends from the top surface of the security indicator ring towards the article for receipt by a recess in the article to prevent rotation of article about the sensor housing. An electrical cord again provides power to the alarm sensor while providing a link to communicate with a remote alarm detection unit, towards determining the current orientation of the detector switch and, in turn, whether an alarm event is occurring. The electrical cord provides power not only to the alarm sensor but also to the article, through a power output port capable of producing and providing electrical current of varying voltages to at least electrically operate the article. Controlling the voltage of the power output port is a voltage selection switch for selecting a desired voltage from amongst a plurality of available voltages adjacent the power output port.

Preferably, the security indicator ring is constantly illuminated when the alarm sensor is receiving power through the electrical cord and the detector switch is in the first orientation and intermittently illuminated when the alarm sensor is receiving power through the electrical cord and the detector switch is in the second orientation. This embodiment also includes a device to visually determining the voltage emanating from the power output port. The voltage outputted is chosen by a slide switch having at least three predetermined positions corresponding to at least three predetermined voltages to be provided by said power output port. The manner of visually determining the voltage emanating from the output port may be at least three light emitting diodes each corresponding to one of the at least three predetermined positions of the slide switch. Preferably, the at least three predetermined positions, voltages and light emitting diodes comprises four predetermined positions, voltages and light emitting diodes.

In this embodiment, an adapter cord for connecting the power output port to the article is included, thereby providing power to the article to permit the article to electrically function. Alternatively, a plurality of adapter cords, may be included, where only one of the adapter cords is for connecting the power output port to the article thereby providing power to the article to permit said article to function. Each of the plurality of adapter cords is configured with a standardized connector for mated connection with the power output port and a non-standard connector for mated connection with the article.

The present invention also includes a method for integrating with an article, a voltage selectable alarm sensor of an anti-theft device comprising the steps of: mounting a sensor housing having top and bottom surfaces, so that the top surface is adjacent the article being monitored when the sensor housing is operably mounted to the article; positioning a detector switch having at least a first and a second orientation proximate the top surface of the alarm sensor so as to be sandwiched between the sensor housing and the article, where the detector switch is in the first orientation to indicate that the alarm sensor is operably and properly mounted on the article and in the second orientation to indicate that the alarm sensor is not operably and properly mounted onto the article thereby causing an alarm event; powering the alarm sensor through an electrical cord towards further powering the article from an output port located on the sensor housing; communicating with a remote alarm detection unit through the electrical cord towards determining the current orientation of the detector switch and whether, in turn, an alarm event is occurring; selecting a voltage at the alarm sensor from a plurality of voltages capable of being transmitted by the output port in the alarm sensor to power the article being monitored; selecting an appropriate adapter cord from amongst multiple adapter cords for at least electrically connecting the alarm sensor to the article; and directing electrical current from the alarm sensor to the article through the adapter cord, to electrically power the article.

Another alternative embodiment of the invention comprises a voltage selectable alarm sensor for operably mounting an anti-theft device to an article being monitored. The alarm sensor comprises a sensor housing and a cap positionable on said housing. The cap has a top surface and a bottom surface opposite thereto, where said top surface is adjacent said article being monitored when said sensor is operably mounted to said article. The sensor also comprises means for releasably mounting said alarm sensor onto said article being monitored, said means for mounting said alarm being accessible only when said cap is separated from said sensor housing. The sensor also comprises a detector switch operably positioned in said sensor housing and having a vertically movable switch member movable between at least first and second positions, in which said first orientation of said detector switch indicates that said cap is operably and properly mounted on said sensor housing and said second orientation of said detector switch indicates that said cap is not operably and properly mounted onto said sensor housing thereby causing an alarm event. An electrical cord provides power to said alarm sensor. The electrical cord also provides a means for communicating with a remote alarm detection unit towards determining the current orientation of said detector switch and whether, in turn, an alarm event is occurring. The electrical cord also provides power to said article being monitored. The sensor housing also includes a power output port capable of producing and providing electrical current of varying selectable voltages to electrically operate a plurality of said articles at a plurality of varying voltages, respectively; and a voltage selection switch for selecting a desired electrical voltage from amongst said plurality of available varying voltages to operate said article.

DETAILED DESCRIPTION OF THE DRAWINGS

Figure 1:
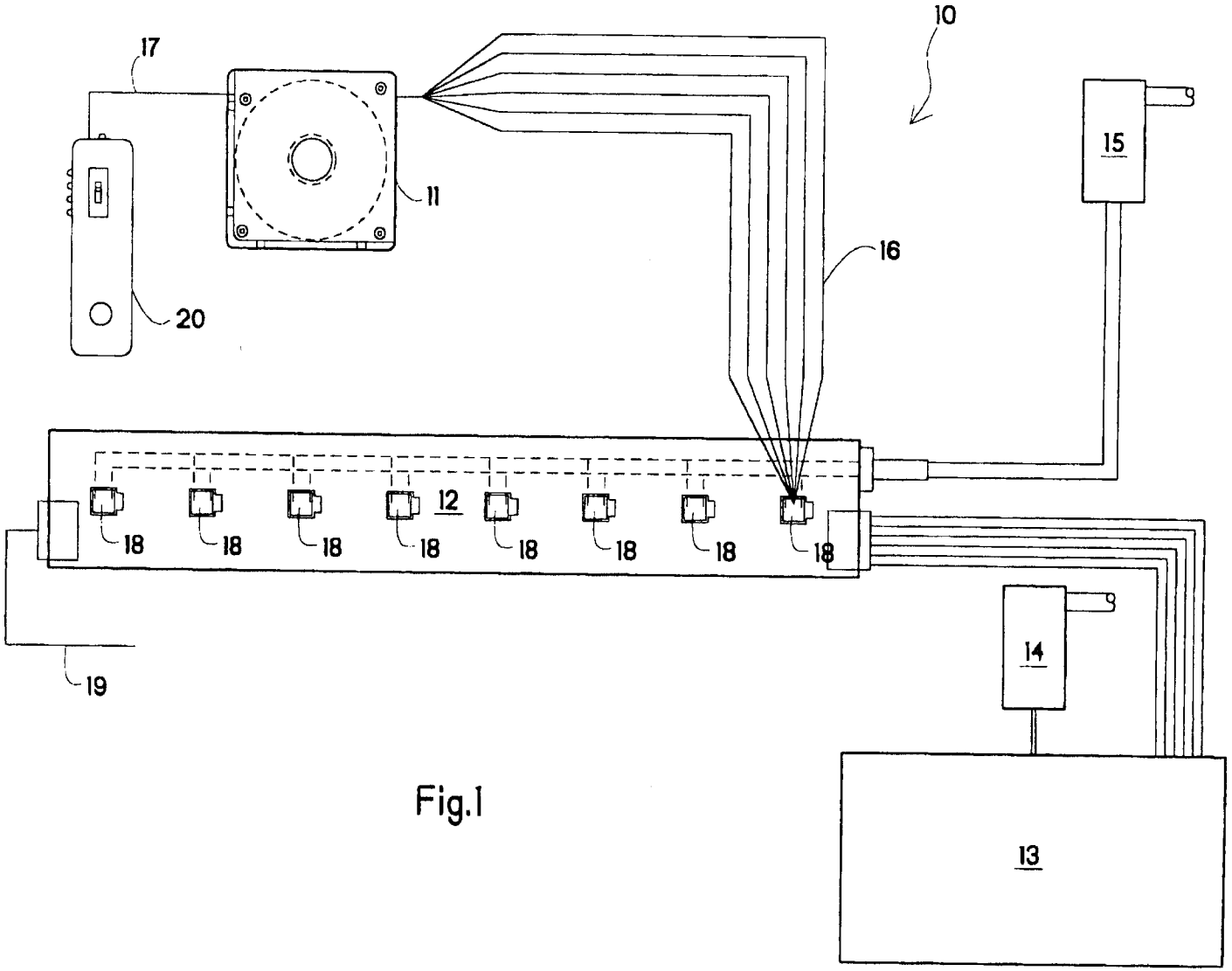
FIG. 1 is a schematic view of the present anti-theft device system incorporating the voltage selectable alarm sensor.

While this invention is susceptible of embodiment in many different forms, there are shown in the drawings and will herein be described in detail, several specific embodiments, with the understanding that the present invention is to be considered as an exemplification of the principle's of the invention and is not intended to limit the invention to the embodiments illustrated.

The circuitry of an anti-theft system 10 is schematically illustrated in FIG. 1. Controlling the system is remote alarm detection unit 13, which is powered by power supply 14. While it is shown that alarm detection unit 13 has an external A/C power supply 14, it is also known in the art to incorporate a power supply into remote alarm detection 13 with unit 13 being powered by battery. While it is possible for voltage selectable alarm sensor 20 to be connected directly to remote alarm detection unit 13, sensor 20 is connected indirectly to remote alarm detection unit 13, as shown. In this configuration, remote alarm detection unit 13 is then connected to a junction box sometimes referred to as a hub or splitter 12.

In this configuration, splitter 12 has its own separate power source 15, different than power source 14 connected to remote alarm detection unit 13. Again, as with the remote alarm detection unit 13, splitter 12 may be powered by either A/C current as shown in FIG. 1, or alternatively through a D/C source such as battery. Splitter 12 includes a number of sensor receptors 18. Sensor receptors 18 are electrical jacks, which receive the matching plug connectors from the end of cord 16. The connector on the end of cord 16 may be of any type of common plug connector used and known to those skilled in the art, for connecting signal generating appliances. One type of common connector is an RJ11 plug with a matching RJ11 jack within splitter 12. Alternatively, the connectors may be coaxial cable connectors or RCA type plug connectors.

Again, voltage selectable alarm sensor 20 may be connected directly to splitter 12 at sensor receptor port 18. However in FIG. 1, powered recoiler 11 is connected between voltage selectable alarm sensor 20 and splitter 12. Powered recoilers are known in the art and are used to provide a method for extending the distance between splitter 12 and alarm sensor 20 when sensor 20 is attached to a portable article being monitored. In particular, cord 16 is connected, or "plugged in to", sensor receptor port 18. As shown in FIG. 1, cord 16 comprises six (6) wires. Two (2) of those wires carry electrical current, i.e. power, from splitter 12 through and to alarm sensor 20. Another wire carries an alarm signal, which signal would indicate whether alarm sensor 20 is properly attached to an article being monitored, or alternatively whether an alarm event is occurring. One wire is used by the light emitting diode or LED within sensor 20, which LED indicates whether sensor 20 is powered. The wires carrying the alarm signal and the LED share a common return wire. The last wire within cord 16 is a common ground. Accordingly, cord 16 carries not only power to the sensor, but also carries alarm signals between the sensor and remote alarm detection unit 13. Typically, cord 16 is of a fixed length. In contrast, electrical cord 17 is retractable into recoiler 11 so as to provide the necessary length of cord for attaching sensor 20 to an article. Electrical cord 17 carries the same number of wires and electrical signals as that of cord 16. Electrical cord 17 is then connected to sensor 20 so as to connect, indirectly, sensor 20 to remote alarm detected unit 13, thereby completing anti-theft device system 10.

Figures 2, 3, 4:
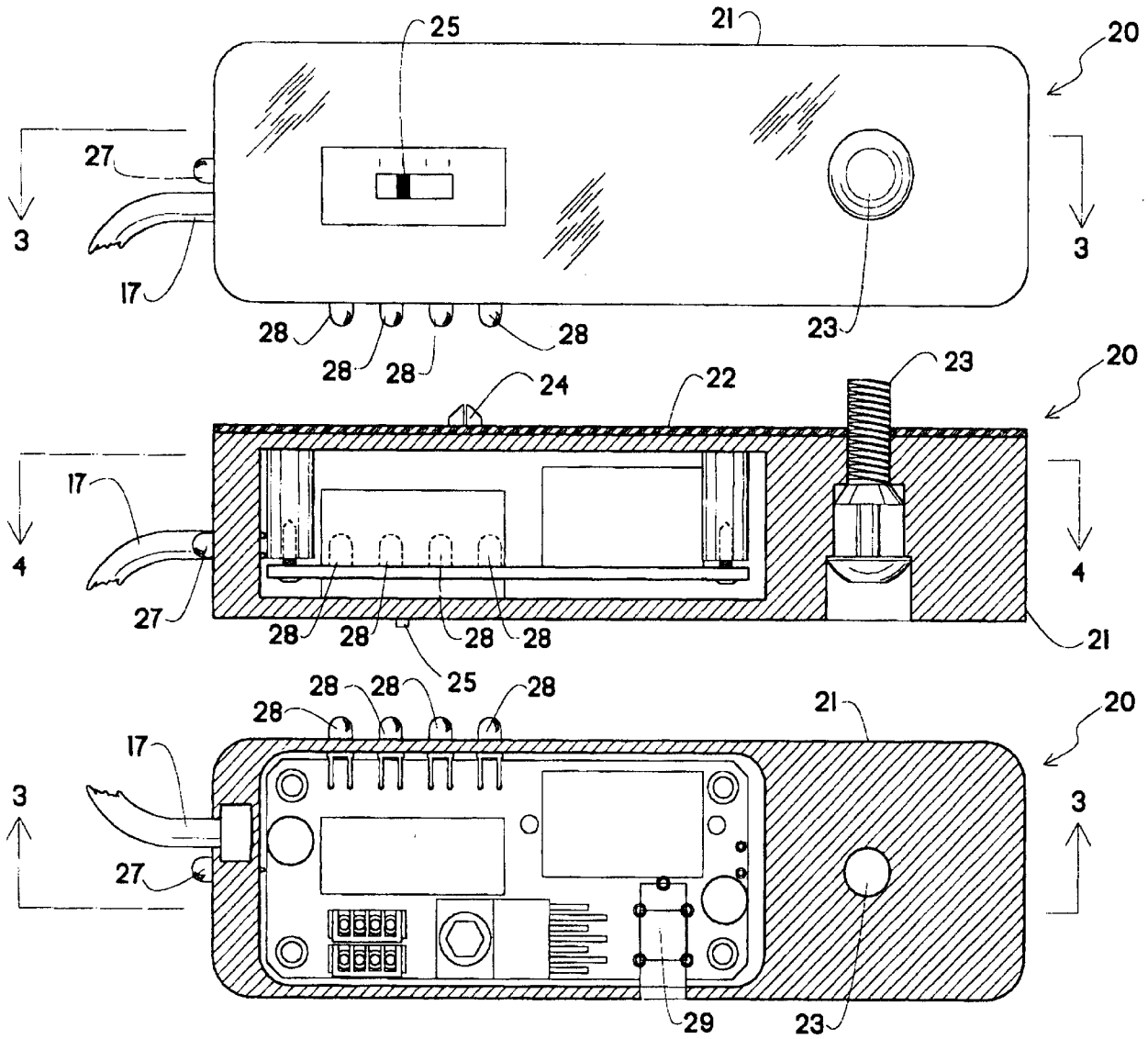
FIG. 2 is a bottom plan view of one preferred embodiment of a voltage selectable alarm sensor.
FIG. 3 is an elevated cross sectional side view of the same preferred embodiment of the voltage selectable alarm sensor taken along lines 3—3 of FIGS. 2 and 4, and looking in the direction of the arrows.
FIG. 4 is a cross sectional view taken along lines 4—4 of FIG. 3, and looking in the direction of the arrows, showing the voltage selectable alarm sensor thereof.

FIGS. 2 through 4 generally show a preferred embodiment of the voltage selectable alarm sensor 20. Voltage selectable alarm sensor 20 includes a substantially rectangular housing 21 that is mounted onto an article to be monitored against theft, through mounting bolt 23. As depicted in FIG. 3, mounting bolt 23 may be a threaded bolt or screw to be received into the threaded aperture of the article. Of course, other types of mounting means known to those skilled in the art would also be acceptable. For example, instead of a threaded bolt, the bolt may have a tongue-and-groove, or bayonet arrangement with the aperture located in the article. Sensor 20 also contains a layer of releasable adhesive 22 located on the top surface of sensor housing 21. When sensor 20 is properly mounted onto an article, that article will engage adhesive 22 so as to further restrain sensor 20 to the article. While it is not recommended, it is possible to forego a mounting means such as threaded bolt 23 and simply rely upon the releasable adhesive 22 for mounting sensor 20 onto the article. As it should be appreciated, merely relying upon adhesive 22 is less secure than utilizing both mounting means such as threaded bolt in combination with releasable adhesive 22.

When sensor 20 is properly mounted to article 60, the article will engage detector switch 24. Detector switch 24 is a common microswitch that has at least two different orientations. The first, or unsecured orientation is shown in FIG. 3 where detector switch 24 extends past a top surface of sensor housing 21 and adhesive layer 22. In this orientation, sensor 20 transmits a signal to remote alarm detection unit 13 (of FIG. 1) that the article being monitored is not properly attached thereby causing an alarm event. An alarm event is an indication that the article attached to the sensor is not completely and properly attached to the sensor and/or that the article may have been subjected to an attempted theft. In either event, an alarm event indicates that the sensor may require attention and possibly some corrective action.

When an article is properly mounted on sensor 20, detector switch 24 is in a second orientation where switch 24 is substantially even with the top surface of sensor housing 21. In this orientation, a signal is generated by the sensor and sent to remote alarm detection unit 13 indicating that sensor 20 is operating properly and is properly mounted to the article being monitored. As explained above, and as further shown in FIGS. 2 through 4, sensor 20 is powered by electrical cord 17. In addition to providing power to sensor 20, electrical cord 17 transmits signals between sensor 20 and remote alarm unit 13, towards indicating whether an article is secured on sensor 20 or an alarm event may be occurring. Sensor 20 also includes means for indicating whether sensor 20 is receiving power through cord 17. In this embodiment, light emitting diode (LED) 27 illuminates when sensor 20 receives power through cord 17. If sensor 20 is properly mounted to the article, then LED 27 illuminates continuously. In contrast, when sensor 20 is receiving power and the article is not properly mounted on sensor 20, LED 27 only illuminates intermittently, e.g. flashes or blinks, thereby indicating an alarm event. Of course, it is known in the industry that a change in color of an LED may also indicate whether power is being received, or that an alarm event is occurring.

Figures 5, 6, 7, 8:
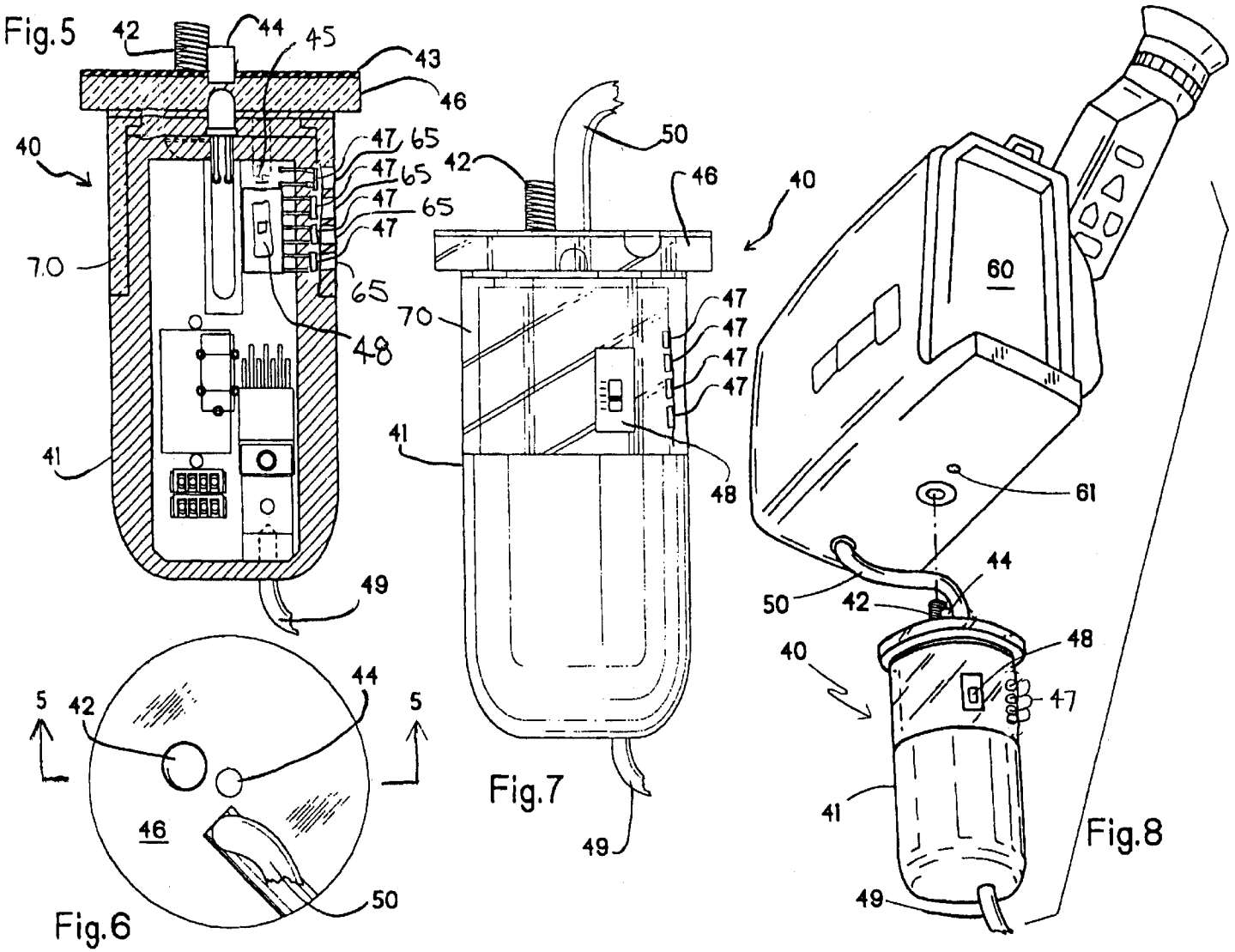
FIG. 5 is an elevated cross sectional side view of another preferred embodiment of a voltage selectable alarm sensor, taken along lines 5—5 of FIG. 6 and looking in the direction of the arrows.
FIG. 6 is a top plan view of the preferred voltage selectable alarm sensor of FIG. 5.
FIG. 7 is an elevated side view of the embodiment of the voltage selectable alarm sensor of FIGS. 5 and 6.
FIG. 8 is an exploded perspective view from underneath a monitorable video camera showing a typical mounting orientation of one preferred embodiment of the voltage selectable alarm sensor.

As further shown in FIGS. 2 through 4, sensor 20 is also used to transmit power to the article being monitored so that the article may function electrically. Power received from cord 17 is transmitted through sensor 20 and transmitted through power output port 29. An adapter cord, such as adapter cord 50 in FIG. 8, is connected to power output port 29 and then connected to the power input jack of the article being monitored. However, as articles tend to require different voltages to be powered, the voltage transmitted by power output port 29 may be selectively and appropriately limited by sensor 20. A voltage selection switch that has at least three (3) positions selects the voltage. In the preferred embodiment, the voltage selection switch is a four (4) position slide switch 25. Slide switch 25 is positioned so as to be accessible from the bottom surface of sensor housing 21. The voltages transmitted through power output port 29 and selected by switch 25 may be any one of four predetermined voltages, such as 4 volts, 6 volts, 8 volts and 9 volts. These voltages are achieved by "stepping down" the voltage received by sensor 20 through cord 17, which voltage is typically 12 or 15 volts. In this embodiment, sensor 20 also includes a means for visually indicating the particular, selected voltage being transmitted by power output port 29. As shown in FIGS. 2 through 4, four light emitting diodes 28 are used to indicate which of four voltages is being transmitted. Depending upon which voltage is being transmitted, namely 4, 6, 8 or 9 volts, the appropriate LED would light. Instead of light emitting diodes, other means such as color indicators, or liquid crystal displays may be used to indicate the specific voltage being outputted by power output port 29.

Another embodiment of the invention is shown in FIGS. 5 through 8. Here, alarm sensor 40 has a substantially cylindrical housing 41, and cap 70 with threaded bolt 42. Housing 41 and cap 70 may be connected to one another by any suitable means, such as a threaded engagement, forced or snap fit, etc. Power is supplied to sensor 40 through cord 49, which also transmits signals between sensor 41 and a remote alarm detection unit (not shown). Sensor 40 also includes a security indicator ring 46. Security indicator ring 46 is a substantially circular, translucent piece of plastic that is positioned proximate to and extending around the circumference of the top of sensor housing 41. Security indicator ring 46 illuminates to indicate that power is being supplied to sensor 40. Additionally, security indicator ring 46 may be used to indicate that an alarm event is occurring, as in the prior embodiment, through blinking, flashing or other means known in the art. Because security indicator ring 46 is positioned around the circumference of housing 41, it is viewable from a wide range of locations, unlike the use of a LED, which may be obscured depending upon the location of the viewer and article, relative to the sensor. It would also be known in the art to indicate an alarm event through a change in color or brightness in the security indicator ring 46.

Sensor 40 is preferably mounted to the article (such as article 60) through threaded bolt 42 and releasable adhesive layer 43. The head of bolt 42 is accessible only when cap 70 and housing 41 are separated. Therefore, article 60 cannot be removed from sensor 40, once attached, unless cap 70 and housing 41 are separated. Accordingly, to detect the separation of cap 70 from housing 41, a two-position switch is provided in the interior of housing 41, which is appropriately connected to the sensor electrical circuitry, such that a change in the state of the switch will indicate a possible theft attempt. The switch, of the type which is generally known to those of ordinary skill in the art (and so the specific details of which are omitted for simplicity of the illustration), will preferably include a vertically moving switch member 45. Switch member 45 preferably will be movable between an upper position (above the upper edge of housing 41) and a lower position (shown in FIG. 5) and will preferably be biased toward the upper position by any suitable biasing means, such as a coil spring (not shown). When cap 70 is fully positioned down on housing 41, switch member 45 is pushed down by the underside surface of cap 70 to its lower position (shown in FIG. 5). As is customary with such switches, switch member 45 will either make or break an electrical connection when moved from the lower position to the upper position, so that the switch will either cause a signal to be sent or interrupted, indicating separation of cap 70 from housing 41, indicating a possible theft attempt.

Protruding from the top of security indicator ring 46 is stabilization peg 44. Stabilization peg 44 is received by recessed portion 61 in camera 60. Inserting stabilization peg 44 into recessed portion 61 prevents camera 60 from being inadvertently rotated about sensor 40 so as to adversely loosen it from threaded bolt 42 thereby indicating an improper alarm event.

Sensor 40 is electrically connected to camera 60 through adapter cord 50. As shown in FIG. 6, adapter cord 60 is plugged into the power output port on the top of security indicator ring 46 and lies in a channel so as to be substantially level with the top of security indicator ring 46 when mounted on camera 60. The other end of adapter cord 50 is then plugged into the power intake jack of camera 60 as shown in FIG. 8. As in the other described embodiment, the voltage transmitted through adapter cord 50 may be selected and limited by sensor 40 through selection switch 48. The selected voltage being transmitted by sensor 40 to camera 60 is then indicated by light emitting diodes 47, mounted in housing 41, and visible through aperture openings or, alternatively, windows 65 in cap 70, as are shown in FIG. 5.

It is envisioned that adapter cord 50 would have a standardized connection for insertion into power output port of sensor 40. Unfortunately, camera manufacturers provide their own proprietary power input jacks of differing configuration. Accordingly, the other end of adapter cord 50 that is "plugged" into camera 60 will have to be non-standardized and particular to the camera being powered, and selected from an available "inventory" of connectors all fitting the output jack at the sensor, but with differing article input jacks.

Another embodiment of the invention is shown in FIGS. 9 through 12, which is similar to the embodiment of FIGS. 5–8, such that similar structural elements are given similar reference numerals augmented by a prime (').

Here, alarm sensor 40' has a substantially cylindrical housing 41', and cap 70' with threaded bolt 42'. Housing 41' and cap 70' may be connected to one another by any suitable means, such as a threaded engagement, forced or snap fit, etc. Power is supplied to sensor 40' through cord 49', which also transmits signals between sensor 41' and a remote alarm detection unit (not shown). Sensor 40' also includes a security indicator ring 46'. Security indicator ring 46' is a substantially circular, translucent piece of plastic that is positioned proximate to and extending around the circumference of the top of sensor housing 41'. Security indicator ring 46' illuminates to indicate that power is being supplied to sensor 40'. Additionally, security indicator ring 46' may be used to indicate that an alarm event is occurring, as in the prior embodiment, through blinking, flashing or other means known in the art. Because security indicator ring 46' is positioned around the circumference of housing 41', it is viewable from a wide range of locations, unlike the use of an LED, which may be obscured depending upon the location of the viewer and article, relative to the sensor. It would also be known in the art to indicate an alarm event through a change in color or brightness in the security indicator ring 46'.

Sensor 40' may also be mounted to the article (such as article 60') through threaded bolt 42' and releasable adhesive layer 43'. In this alternative embodiment, again, a two-position switch may be provided (the specific details of which are omitted, but which are known to those of ordinary skill in the art), that is suitably connected to the circuitry, such that a change in state of the switch will generate or alter an electrical signal, signifying an attempted tampering with the sensor. In the embodiment of FIGS. 9–12, however, the switch is configured to detect an attempted separation of sensor 40' from article 60'. That is, vertically movable switch member 45', in its biased upper position, extends through an aperture in cap 70'. When sensor 40' is attached to article 60', the bottom of article 60' pushes switch member 45' down until its upper end is substantially flush with the upper surface of cap 70'. An attempted forcible separation of article 60' from sensor 40' will cause switch member 45' to be able to move up from its lower position shown in FIG. 9, thus causing a change of state, which will cause an electrical connection to be made or broken, resulting in an alert signal.

Protruding from the top of security indicator ring 46' is stabilization peg 44'. Stabilization peg 44' is received by recessed portion 61' in camera 60'. Inserting stabilization peg 44' into recessed portion 61' prevents camera 60' from being inadvertently rotated about sensor 40' so as to adversely loosen it from threaded bolt 42' thereby indicating an improper alarm event.

Figures 9, 10, 11, 12:
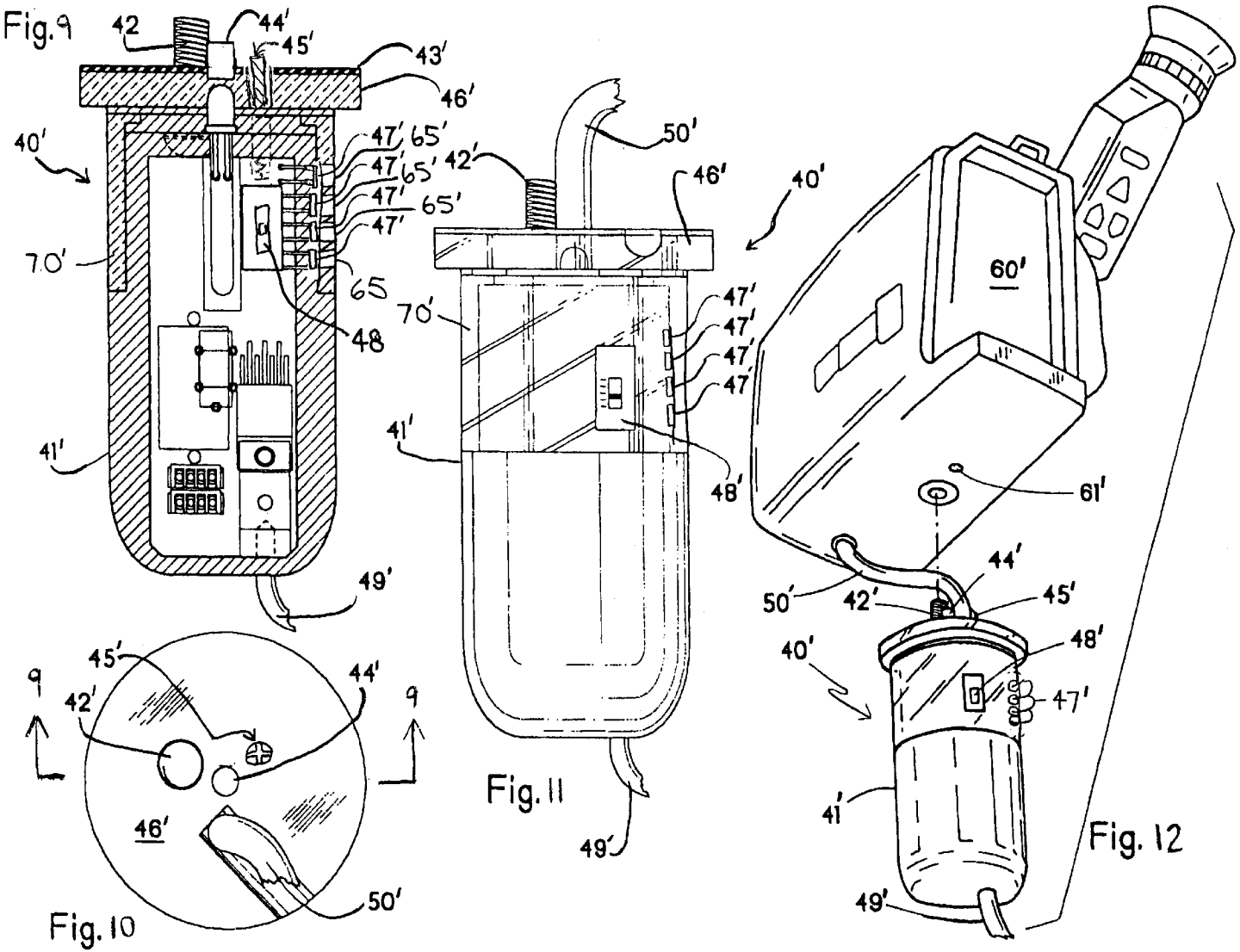
FIG. 9 is an elevated cross sectional side view of another preferred embodiment of a voltage selectable alarm sensor, taken along lines 9—9 of FIG. 10 and looking in the direction of the arrows.
FIG. 10 is a top plan view of the preferred voltage selectable alarm sensor of FIG. 9.
FIG. 11 is an elevated side view of the embodiment of the voltage selectable alarm sensor of FIGS. 9 and 10.
FIG. 12 is an exploded perspective view from underneath a monitorable video camera showing a typical mounting orientation of one preferred embodiment of the voltage selectable alarm sensor.

Sensor 40' is electrically connected to camera 60' through adapter cord 50'. As shown in FIG. 10, adapter cord 60' is plugged into the power output port on the top of security indicator ring 46' and lies in a channel so as to be substantially level with the top of security indicator ring 46' when mounted on camera 60'. The other end of adapter cord 50' is then plugged into the power intake jack of camera 60' as shown in FIG. 12. As in the other described embodiment, the voltage transmitted through adapter cord 50' may be selected and limited by sensor 40' through selection switch 48'. The selected voltage being transmitted by sensor 40' to camera 60' is then indicated by light emitting diodes 47', mounted in housing 41', and visible through aperture openings or, alternatively, windows 65' in cap 70', as are shown in FIG. 9.

It is envisioned that adapter cord 50' would have a standardized connection for insertion into power output port of sensor 40'. Unfortunately, camera manufacturers provide their own proprietary power input jacks of differing configuration. Accordingly, the other end of adapter cord 50' that is "plugged" into camera 60' will have to be non-standardized and particular to the camera being powered, and selected from an available "inventory" of connectors all fitting the output jack at the sensor, but with differing article input jacks.

The foregoing description and drawings merely explain and illustrate the invention, and the invention is not limited thereto except insofar as the pending claims are so limited as those skilled in the art who have the disclosure before them will be able to make modifications and variations therein without departing from the scope of the invention.

What we claimed is:

1. A voltage selectable alarm sensor for operably mounting an anti-theft device to an article being monitored, said alarm sensor comprising:

a sensor housing having a top surface and a bottom surface opposite thereto, where said top surface is adjacent said article being monitored when said sensor housing is operably mounted to said article;

means for mounting said alarm sensor onto said article being monitored;

a detector switch operably positioned proximate said top surface of said alarm sensor having at least a first and a second orientation, in which said first orientation of said detector switch indicates that said alarm sensor is operably and properly mounted on said article and said second orientation of said detector switch indicates that said alarm sensor is not operably and properly mounted onto said article thereby causing an alarm event;

an electrical cord for providing power to said alarm sensor, said electrical cord also providing a means for communicating with a remote alarm detection unit towards determining the current orientation of said detector switch and whether, in turn, an alarm event is occurring, said electrical cord also providing power to said article being monitored;

said sensor housing including a power output port capable of producing and providing electrical current of varying selectable voltages to electrically operate a plurality of said articles at a plurality of varying voltages, respectively; and a voltage selection switch for selecting a desired electrical voltage from amongst said plurality of available varying voltages to operate said article.

2. The voltage selectable alarm sensor according to claim 1 wherein said mounting means includes a layer of releasable adhesive applied to said top surface of said sensor housing so as to be sandwiched between said alarm sensor and said article being monitored, when said alarm sensor is mounted on said article.

3. The voltage selectable alarm sensor according to claim 1 wherein said alarm sensor further includes means for visually determining the orientation of said detector switch.

4. The voltage selectable alarm sensor according to claim 1 wherein said alarm sensor further includes means for visually determining said voltage selected for transmission through said power output port, to said article.

5. The voltage selectable alarm sensor according to claim 1 in which said voltage selection switch is a slide switch having at least three predetermined positions for selecting said voltage transmitted to said power output port.

6. The voltage selectable alarm sensor according to claim 1 in which said voltage selection switch is a slide switch having four predetermined positions for selecting said voltage transmitted to said power output port.

7. The voltage selectable alarm sensor according to claim 1 wherein said mounting means includes a threaded fastener that extends from said top surface of said sensor housing for mated receipt by a threaded aperture located in said article being monitored.

8. The voltage selectable alarm sensor according to claim 1 further including an adapter cord for connecting said power output port to said article thereby providing power to said article to permit said article to function.

9. The voltage selectable alarm sensor according to claim 1 further including a plurality of adapter cords, where one of said adapter cords for connecting said power output port to said article thereby providing power to said article to permit said article to function.

10. The voltage selectable alarm sensor according to claim 9 in which each of said plurality of adapter cords are configured with a standardized connector for mated connection with said power output port and a non-standard connector for mated connection with said article being monitored.

11. A voltage selectable alarm sensor for operably mounting an anti-theft device to an article being monitored, said article being monitored including a threaded mounting aperture, said alarm sensor comprising:

a substantially rectangular sensor housing having a top surface and a bottom surface, where said top surface is adjacent said article being monitored when said sensor housing is operably mounted to said article;

a layer of releasable adhesive applied to said top surface of said sensor housing so as to be sandwiched between said alarm sensor and said article being monitored when said alarm sensor is mounted on said article;

a threaded fastener that extends from said top surface of said sensor housing for mated receipt by said threaded mounting aperture located in said article being monitored;

a detector switch operably positioned proximate said top surface of said sensor housing having at least a first and a second orientation, where said first orientation indicates that said alarm sensor is operably and properly mounted on said article and said second orientation indicates that said alarm sensor is not operably and properly mounted onto said article thereby causing an alarm event;

an electrical cord for providing power to said alarm sensor, said electrical cord also providing a means for communicating with a remote alarm detection unit towards determining the current orientation of said detector switch and, in turn, whether an alarm event is occurring;

said electrical cord also for providing power to said alarm sensor and said article being monitored;

a power output port capable of producing and providing electrical current of one of at least three predetermined voltages as transmitted from said electrical cord;

a slide switch having at least three predetermined positions for selecting said voltage provided by said power output port to one of at least three predetermined voltages;

a light emitting diode for visually indicating whether said detector switch is in said first orientation or said second orientation; and a set of at least three light emitting diodes each respectively corresponding to each of said at least three predetermined positions of said slide switch and said at least three predetermined voltages and illuminating so as to indicate which of said at least three predetermined voltages is provided by said power output port.

12. The voltage selectable alarm sensor according to claim 11 wherein said light emitting diode for visually indicating said orientation of said detector switch is constantly illuminated when said alarm sensor is receiving power through said electrical cord, while said detector switch is in said first orientation and intermittently illuminated when said alarm sensor is receiving power, while said detector switch is in said second orientation.

13. The voltage selectable alarm sensor according to claim 11 further including an adapter cord for connecting said power output port to said article thereby providing electrical power to said article to enable operation of said article.

14. The voltage selectable alarm sensor according to claim 11 further including a plurality of adapter cords, where one of said adapter cords for connecting said power output port to said article thereby providing power to said article to enable the operation of said article.

15. The voltage selectable alarm sensor according to claim 14 in which each of said plurality of adapter cords are configured with a standard connector for mated connection with said power output port and a non-standard connector for mated connection with said article being monitored.

16. A voltage selectable alarm sensor for operably mounting an anti-theft device to an article being monitored, said alarm sensor comprising:

a substantially cylindrical sensor housing having a top end and a bottom end opposite thereto, where said top end is proximate to said article being monitored when said sensor housing is operably mounted to said article;

means for mounting said alarm sensor onto said article being monitored;

a detector switch having at least a first and a second orientation, in which said first orientation indicates that said alarm sensor is operably and properly mounted on said article and in which said second orientation indicates that said alarm sensor is not operably and properly mounted onto said article thereby causing an alarm event;

a substantially circular security indicator ring having a top and bottom surface and positioned so that said bottom surface is adjacent said top end of said sensor housing at said top end's circumference, where said security indicator ring is capable of illumination for visual detection from a range of locations so as to indicate said first and second orientations of said detector switch, which is operably positioned adjacent said indicator ring and said article being monitored; and an electrical cord for providing power to said alarm sensor, said cord also providing a means for communicating with a remote alarm detection unit towards determining the current orientation of said detector switch and, in turn, whether an alarm event is occurring, said electrical cord also for providing power to said alarm sensor and said article being monitored.

17. The voltage selectable alarm sensor according to claim 16 where in said sensor housing further includes:

a power output port capable of producing and providing electrical current of varying voltages to operate said article electrically; and a voltage selection switch for selecting a desired voltage from amongst a plurality of available voltages provided by said power output port to operate said article.

18. A voltage selectable alarm sensor for operably mounting an anti-theft device to an article being monitored, said article being monitored including a threaded mounting aperture, said alarm sensor comprising:

a substantially cylindrical sensor housing having a top end and a bottom end opposite thereto, where said top end is proximate to said article being monitored when said sensor housing is operably mounted to said article;

a detector switch having at least a first and a second orientation, where said first orientation indicates that said alarm sensor is operably and properly mounted on said article and said second orientation indicates that said alarm sensor is not operably and properly mounted onto said article thereby causing an alarm event;

a substantially circular security indicator ring having a top and bottom surface and positioned so that said bottom surface is adjacent said top end of said sensor housing at said top end's circumference, said security indicator ring is capable of illumination for visual detection from a range of locations so as to indicate said first and second orientations of said detector switch, which is operably positioned adjacent said indicator ring and said article being monitored;

a threaded fastener that extends from proximate said top end of said sensor housing through said security indicator ring for mated receipt by said threaded mounting aperture located in said article being monitored;

a stabilization peg extending from said top surface of said security indicator ring towards said article being monitored so as to be received by a recess in said article towards preventing rotation of said article about said sensor housing;

an electrical cord for providing power to said alarm sensor, said cord also providing a means for communicating with a remote alarm detection unit towards determining the current orientation of said detector switch and, in turn, whether an alarm event is occurring, said electrical cord also for providing power to said alarm sensor and said article being monitored;

a power output port capable of producing and providing electrical current of varying voltages to at least electrically operate said article; and a voltage selection switch for selecting a desired voltage from amongst a plurality of available voltages provided by said power output port to operate said article.

19. The voltage selectable alarm sensor according to claim 18 wherein said security indicator ring is constantly illuminated when said alarm sensor is receiving power through said electrical cord and said detector switch is in said first orientation and intermittently illuminated when said alarm sensor is receiving power through said electrical cord and said detector switch is in said second orientation.

20. The voltage selectable alarm sensor according to claim 18 wherein said alarm sensor further includes means for visually determining said voltage emanating from said power output port.

21. The voltage selectable alarm sensor according to claim 20 in which said voltage regulator switch is a slide switch having at least three predetermined positions corresponding to at least three predetermined voltages to be provided by said power output port.

22. The voltage selectable alarm sensor according to claim 21 where said means for visually determining said voltage emanating from power output port comprises at least three light emitting diodes each corresponding to one of said at least three predetermined positions of said slide switch.

23. The voltage selectable alarm sensor according to claim 18 further including an adapter cord for connecting said power output port to said article thereby providing power to said article to permit said article to function.

24. The voltage selectable alarm sensor according to claim 18 further including a plurality of adapter cords, where one of said adapter cords for connecting said power output port to said article thereby providing power to said article to permit said article to function.

25. The voltage selectable alarm sensor according to claim 24 in which each of said plurality of adapter cords are configured with a standardized connector for mated connection with said power output port and a non-standard connector for mated connection with said article being monitored.

26. A voltage selectable alarm sensor for operably mounting an anti-theft device to an article being monitored, said article being monitored including a threaded mounting aperture, said alarm sensor comprising:

a substantially cylindrical sensor housing having a top end and a bottom end opposite thereto, where said top end is proximate to said article being monitored when said sensor housing is operably mounted to said article;

a detector switch having at least a first and a second orientation, where said first orientation indicates that said alarm sensor is operably and properly mounted on said article and said second orientation indicates that said alarm sensor is not operably and properly mounted onto said article thereby causing an alarm event;

a security indicator ring having a top and bottom surface and positioned so that said bottom surface is adjacent said top end of said cylindrical sensor housing at said top end's circumference, said security indicator ring is capable of illumination so as to indicate said first and second orientations of said detector switch, which is operably positioned adjacent said indicator ring and said article being monitored, said security indicator ring is constantly illuminated when said alarm sensor is receiving power through said electrical cord and said detector switch is in said first orientation and intermittently illuminated when said alarm sensor is receiving power through said electrical cord and said detector switch is in said second orientation;

a threaded fastener that extends from proximate said top surface of said security indicator ring for mated receipt by said threaded mounting aperture located in said article being monitored;

a layer of releasable adhesive applied to said top surface of said security indicator ring so as to be sandwiched between said alarm sensor and said article being monitored when said alarm sensor is mounted on said article;

a stabilization peg extending from said top surface of said security indicator ring towards said article being monitored so as to be received by a recess in said article towards preventing rotation of said article about said sensor housing;

an electrical cord for providing power to said alarm sensor, said cord also providing a means for communicating with a remote alarm detection unit towards determining the current orientation of said detector switch and, in turn, whether an alarm event is occurring, said electrical cord also for providing power to said alarm sensor and said article being monitored;

a power output port capable of producing and providing electrical current of varying voltages to at least electrically operate said article;

a slide switch having at least three predetermined positions for selecting said voltage provided by said power output port to one of at least three predetermined voltages; and a set of at least three light emitting diodes each corresponding to one of said at least three predetermined positions of said slide switch and said at least three predetermined voltages and illuminating so as to indicate which of said at least three predetermined voltages is provided by said power output port.

27. The voltage selectable alarm sensor according to claim 26 in which said slide switch having at least three predetermined positions has four positions for selecting said voltage provided by said power output port to one of four predetermined voltages; and said set of at least three light emitting diodes including four light emitting diodes, one each corresponding to one of said four predetermined positions of said slide switch and said four predetermined voltages, towards illuminating each so as to indicate which of said four predetermined voltages is provided by said power output port.

28. The voltage selectable alarm sensor according to claim 26 further including an adapter cord for connecting said power output port to said article thereby providing power to said article to permit said article to function.

29. The voltage selectable alarm sensor according to claim 26 further including a plurality of adapter cords, where a selected one of said adapter cords can connect said power output port to said article, thereby providing power to said article to permit said article to function.

30. The voltage selectable alarm sensor according to claim 29 in which each of said plurality of adapter cords are configured with a standardized connector for mated connection with said power output port and a non-standard connector for mated connection with said article being monitored.

31. A method for attaching a voltage selectable alarm sensor of an anti-theft device to an article being monitored, said method comprising the steps of:

mounting a sensor housing having a top surface and a bottom surface opposite thereto, so that said top surface is adjacent said article being monitored when said sensor housing is operably mounted to said article;

positioning a detector switch having at least a first and a second orientation proximate said top surface of said alarm sensor so as to be sandwiched between said sensor housing and said article, to orient said detector switch in said first orientation to indicate that said alarm sensor is operably and properly mounted on said article and, alternatively, in said second orientation to indicate that said alarm sensor is not operably and properly mounted onto said article thereby causing an alarm event;

powering said alarm sensor through an electrical cord towards further powering said article from an output port located on said sensor housing;

communicating with a remote detection unit through said electrical cord unit towards determining the current orientation of said detector switch and whether, in turn, an alarm event is occurring;

selecting a voltage at said sensor from a plurality of voltages capable of being transmitted by said output port in said alarm sensor to power said article being monitored;

selecting an appropriate adapter cord from amongst multiple adapter cords for at least electrically connecting said sensor to said article; and electrically coupling said sensor to said article, to electrically power said article.

32. A voltage selectable alarm sensor for operably mounting an anti-theft device to an article being monitored, said alarm sensor comprising:

a sensor housing;

a cap positionable on said housing and having a top surface and a bottom surface opposite thereto, where said top surface is adjacent said article being monitored when said sensor is operably mounted to said article;

means for releasably mounting said alarm sensor onto said article being monitored, said means for mounting said alarm being accessible only when said cap is separated from said sensor housing;

a detector switch operably positioned in said sensor housing and having a vertically movable switch member movable between at least first and second positions, in which said first orientation of said detector switch indicates that said cap is operably and properly mounted on said sensor housing and said second orientation of said detector switch indicates that said cap is not operably and properly mounted onto said sensor housing thereby causing an alarm event;

an electrical cord for providing power to said alarm sensor, said electrical cord also providing a means for communicating with a remote alarm detection unit towards determining the current orientation of said detector switch and whether, in turn, an alarm event is occurring, said electrical cord also providing power to said article being monitored;

said sensor housing including a power output port capable of producing and providing electrical current of varying selectable voltages to electrically operate a plurality of said articles at a plurality of varying voltages, respectively; and a voltage selection switch for selecting a desired electrical voltage from amongst said plurality of available varying voltages to operate said article.

33. The voltage selectable alarm sensor according to claim 32 wherein said mounting means includes a layer of releasable adhesive applied to said top surface of said sensor housing so as to be sandwiched between said alarm sensor and said article being monitored, when said alarm sensor is mounted on said article.

34. The voltage selectable alarm sensor according to claim 32 wherein said alarm sensor further includes means for visually determining said voltage selected for transmission through said power output port, to said article.

35. The voltage selectable alarm sensor according to claim 32 in which said voltage selection switch is a slide switch having at least three predetermined positions for selecting said voltage transmitted to said power output port.

36. The voltage selectable alarm sensor according to claim 32 in which said voltage selection switch is a slide switch having four predetermined positions for selecting said voltage transmitted to said power output port.

37. The voltage selectable alarm sensor according to claim 32 wherein said mounting means includes a threaded fastener that extends from said top surface of said sensor housing for mated receipt by a threaded aperture located in said article being monitored.

38. The voltage selectable alarm sensor according to claim 32 further including an adapter cord for connecting said power output port to said article thereby providing power to said article to permit said article to function.

39. The voltage selectable alarm sensor according to claim 32 further including a plurality of adapter cords, where one of said adapter cords for connecting said power output port to said article thereby providing power to said article to permit said article to function.

40. The voltage selectable alarm sensor according to claim 39 in which each of said plurality of adapter cords are configured with a standardized connector for mated connection with said power output port and a non-standard connector for mated connection with said article being monitored.

* * * * *